United States Patent [19]

Domenichiello

[11] Patent Number: 4,811,841

[45] Date of Patent: Mar. 14, 1989

[54] BALLOON CONTAINER FOR FLOWERS AND MACHINE FOR MAKING SAME

[76] Inventor: Peter Domenichiello, 4216 Forest Fire Crescent, Mississauga, Ontario, Canada, L4W 3P5

[21] Appl. No.: 88,564

[22] Filed: Aug. 24, 1987

[30] Foreign Application Priority Data

Jun. 23, 1987 [CA] Canada ..... 540423

[51] Int. Cl.[4] ..... B65D 85/50; B65D 85/52

[52] U.S. Cl. ..... 206/423; 206/522; 47/69; 47/17

[58] Field of Search ..... 206/423, 522; 47/17, 47/69, 29, 28 R

[56] References Cited

U.S. PATENT DOCUMENTS

| | | | |
|---|---|---|---|
| Re 30,531 | 3/1981 | Spector | 47/69 |
| 1,828,295 | 10/1931 | Roy . | |
| 1,951,777 | 3/1934 | Siegler et al. | 47/41 |
| 2,847,805 | 8/1958 | Robbins | 53/24 |
| 2,994,424 | 8/1961 | Selby et al. | 206/46 |
| 3,869,828 | 3/1975 | Matsumoto | 47/34.11 |
| 4,118,890 | 10/1978 | Shore | 47/28 |
| 4,221,078 | 9/1980 | Latham et al. | 47/41 |

FOREIGN PATENT DOCUMENTS

| | | |
|---|---|---|
| 24108 | 9/1950 | Finland . |
| 2061863 | 5/1981 | United Kingdom . |

*Primary Examiner*—Joseph Man-Fu Moy

*Attorney, Agent, or Firm*—Kramer, Brufsky & Cifelli

[57] ABSTRACT

A device and method of constructing articles of fresh cut parts of plants and artificial decorative embodiments. The packaging is characterized by enveloping such articles with an inflated balloon. The article being placed in an open container, a balloon is then inflated and receives the article and container and is then securely attached to the container, thereby enclosing the article. A device for constructing the packaged article employs a rigid conduit which is received in the balloon to facilitate reception of the article and container. The gas used to inflate the balloons can be air or nitrogen. If cut flowers are used, the container is provided with some water and plant food.

8 Claims, 2 Drawing Sheets

BALLOON CONTAINER FOR FLOWERS AND MACHINE FOR MAKING SAME

BACKGROUND OF THE INVENTION

This invention relates to packaging fresh cut parts of plants, such as leaves or flower-bearing stems, or artificial embodiments thereof, and like-sized articles which are displayed for their ornamental appeal; and to supplementing such ornamental appeal.

To improve longevity, such articles require care and protection from damage that may result from accidental striking or dropping, as during transport. To improve appearance, it is useful to prevent accumulation of dust and other air-borne particles on such articles.

It is an object of this invention to provide a packaging designed to improve the longevity and appearance of such articles, and to add ornamental features.

It is a further object of this invention to provide a new method and machine for packaging and displaying decorative articles such as cut flowers.

SUMMARY OF THE INVENTION

According to one aspect of the invention there is provided a process for packaging an article, comprising the sequential steps of disposing the article in a gas-impermeable container with an upwardly opening port, inflating a balloon, enveloping the article from the top with the balloon so inflated, and securing sealingly the balloon so inflated to the port of the container.

In another aspect of the invention, there is provided a device for packaging an article in a container, comprising a source of pressurized gas, an elongate chamber, open at one end, adapted to receive the article and container, and having means for communicating wtih the source of pressurized gas, holding means within said chamber for holding the article and container during movement thereof within the chamber, actuation means secured to the chamber and connected to the holding means for axially moving the holding means within the chamber, and control means for controlling the actuation means and flow of the pressurized gas into the chamber.

According to another aspect of the invention, there is provided a package combination comprising an article, a container having a top and a neck and adapted to receive and hold the article through an opening in the top, the container being gas-impermeable except at the top, an inflated balloon secured to the container in a gas-tight relationship with the neck, whereby the combination of the container and the balloon completely encloses the article.

By way of example, a preferred embodiment of the present invention, and of the process and device for constructing same, is described below in conjunction with the accompanying drawings.

DETAILED DESCRIPTION OF THE PREFERRED EMBODIMENTS

Figure 1:
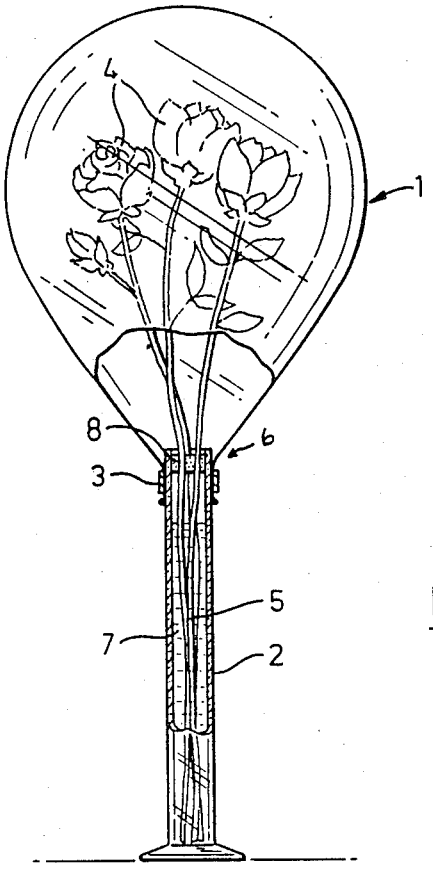
FIG. 1 is a front perspective view, partially broken, of packaged fresh cut flowers, constructed in accordance with the present invention.
Figure 2:
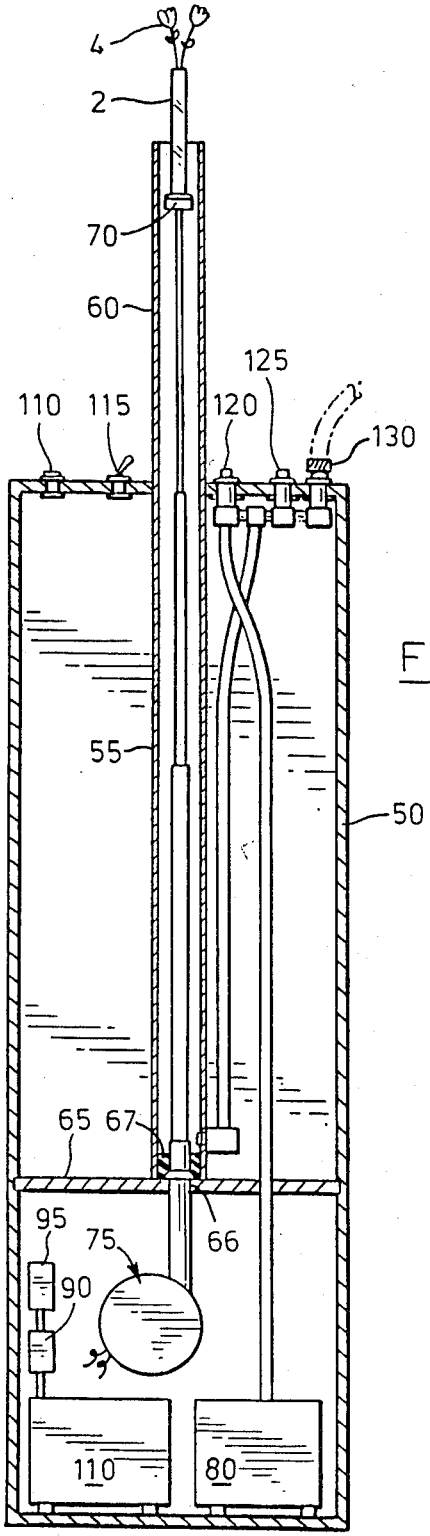
FIG. 2 is a front sectional view of a device for constructing the packaged flowers, as shown in FIG. 1, wherein a vase and flowers are being lowered into the device.
Figure 3:
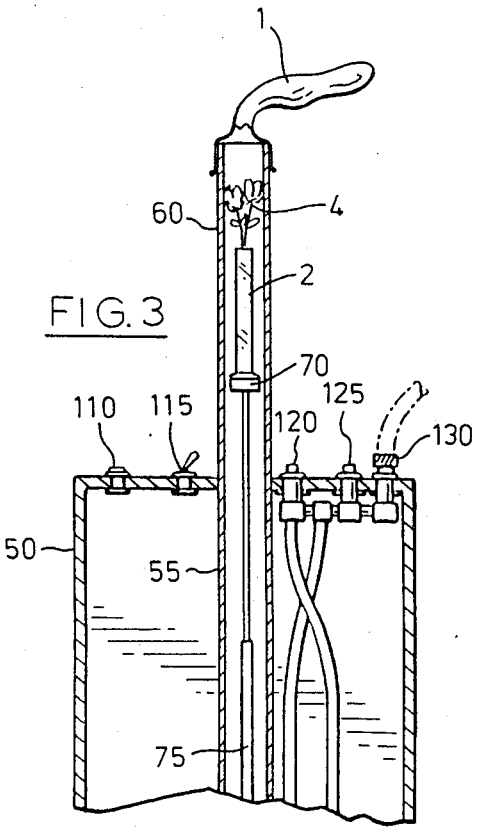
FIG. 3 is a partial front sectional view of the device, when the vase and flowers have been lowered into the device and the balloon has been attached and is being inflated.

In FIG. 1, there is shown an inflated conventional balloon 1 and vase 2 connected in a gas-tight relationship by annular sealing band 3. The balloon 1 is elastomeric, being made of rubber or rubberlike material. Balloon 1 and vase 2 may be transparent, coloured or marked in any ornamentably desirable fashion. Vase 2 is of conventional construction (having in particular a fluid and gas-tight construction and an open top) and is of a conventional profile adapted to receive and hold stems 5 of fresh cut flowers 4, and having a neck 6 small enough to allow balloon 1 to snuggly receive it. Balloon 1 is of a type conventionally available and preferably clear, and is inflatable to accommodate flowers 4. Balloon 1 may be inflated with air or other gases conducive to flowers 4; nitrogen gas or oxygen are usable for this purpose. Water and conventionally available nutrients 7 for flowers 4 are provided in vase 2. A foraminous annular securing device 8 which can be of known construction, is snuggly disposed within vase 2 to securely arrange stems 5. Referring to the device in FIGS. 2 and 3, disposed in a cabinet 50 there is a vertically disposed cylindrical chamber 55 with an internal diameter sufficient to receive slidably vase 2 and flowers 4. The internal height of chamber 55 is sufficient to accommodate at least the combined height of vase 2 and flowers 4 arranged therein. Chamber 55 is open on the top with top portion 60 and is closed at the bottom, sealingly secured to a horizontal shelf 65 of cabinet 50 by conventional means, such as welding and a silicon seal at 67.

There is a disc platform 70 elevatable or lowerable within chamber 55 by conventional telescopic actuation means 75 disposed under shelf 65 and extending upward therethrough at bore 66. Conventional means, such as welding and silicon seals, are provided at 67 to seal and secure actuation means 75 to chamber 55 in a gas-tight relationship. A conventional automatic car antenna actuator (for example, HARADA MXI) may be employed as actuation means 75. Platform 70 has a diameter less than the internal diameter of the chamber 55 so as to form an annular orifice and is profiled to shoulder vase 2 in a stable manner as it is lowered or elevated.

There is conventional air pumping means, designated as 80, which is disposed near chamber 55 and is in controlled communication therewith through switch-valve means 120. Additionally, there is an auxilliary conventional coupler 130, adapted to receive pressurized gas from an external source (not shown), connected to conventional valve 125 which controls communication with chamber 55.

Figure 4:
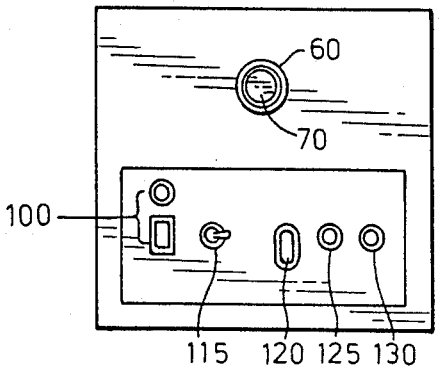
FIG. 4 is a top view of the device illustrated in FIGS. 2 and 3.

For carrying out the process of packaging, to be describd below, there are electric control means as illustrated in circuit schematic form in FIG. 5, and illustrated in the top schematic view of the device in FIG. 4.

Figure 5:
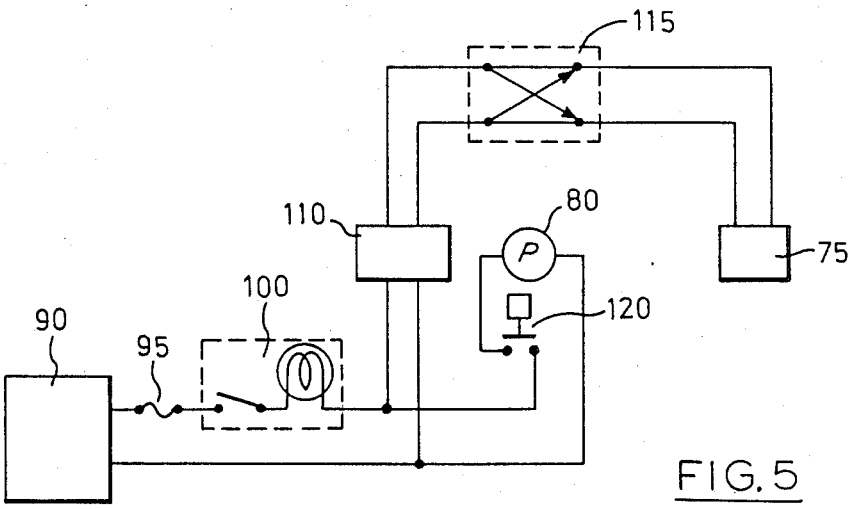
FIG. 5 is a circuit schematic of the electric control means for the device illustrated in FIGS. 2 to 4.

In FIG. 5, a conventional 120 volt AC source is designated at 90 and is connected to a step down transformer and converter, generally designated as 110, and is controlled by fuse or circuit breaker 95 and switch and on-light combination 100. Conventional transformer and converter 110 step down and convert 120 volts AC to 12 volts DC, which is then fed to actuation means 75 and controlled by switch means 115. Source 90 is also connect to air pumping means 80, which is controlled by conventional switch 120.

The process of constructing the packaged plant with the above described device is as follows. Flowers 4 and stems 5 are arranged in vase 2, as hereinbefore described, and platform 70 is raised within the chamber 55 by actuation means 75 to a height that permits the manual placement of vase 2 on platform 70 without undue difficulty. So placed, platform 70 is lowered by actuation means 75 until the top of flowers 4 is below the top of the chamber 55. Balloon 1 is then manually placed over the top portion 60 of chamber 55 in a gas-tight relationship therewith. Air is pumped into chamber 55 to inflate balloon 1 to the desired size, usually large enough to enclose flowers 4 without contact therewith. After inflation, vase 2 and flowers 4 are elevated into inflated balloon 1 by actuation means 75 until a portion of vase 2 is exposed above top portion 60 of chamber 55. At this stage, flowers 4 will be enveloped by inflated balloon 1. Balloon 1 is then manually slid off top portion 60 of chamber 55 to grip the said exposed portion of vase 2, which grip is further secured by elastic band 3 so as to form a gas-tight relationship between balloon 1 and vase 2.

As with any fresh cut flowers, it is preferable to keep the packaged plant, as hereinabove described, in a cool, dry environment.

Variations to the above described preferred embodiment within the spirit of the invention include the following. It will be apparent that articles like feathers, dehydrated plants, small toys like plush dolls and decorative seeds on suitable stems may be packaged according to the invention. Different sizes of vases and articles may be packaged through appropriate and routine modification of the above described process. Platform 70 may be perforated to permit easier flow of gas therethrough. For fresh cut flowers, it has been found that nitrogen gas is a suitable gas. According to the physical characteristics and requirements of the articles packaged, balloons of different characteristics may be employed to enhance the longevity of the packaged articles, including those characteristics related to the permeability of oxygen, carbon dioxide and water. Alternatively, appropriate coatings may be applied to the balloon to prevent the formation of water droplets in the balloon or to maintain the shine of the balloon. For example, coating the outer surface of the inflated balloon with thinned Hi-Float(*) coating (one part Hi-Float to three parts water) has been to prolong the shine.

(*) Hi-Float is a trade mark of Hi-Float Company of Louisville, Ky.

I claim:

1. A package combination comprising:

(a) an article;

(b) a container having a top and a neck portion adjacent to said top and adapted to receive and hold said article through an opening in the top, said container being gas-impermeable except at the said top;

(c) an inflated, resilient balloon having a mouth which is resiliently biased around the neck portion of said container and secured in a gas-tight relationship with said neck portion, whereby the combination of said container and said balloon completely encloses said article.

2. A package combination according to claim 6 wherein said balloon is elastomeric and is made of rubber or a rubberlike material.

3. A package combination according to claim 6 wherein said mouth of said inflated balloon is secured to said neck portion in a gas-tight relationship by the frictional grip of an elastic band.

4. A package combination according to claim 6 wherein said article is a fresh-cut plant and said balloon is inflated with a gas or gases conducive to the maintenance of said plant.

5. A package combination according to claim 3 wherein said article is a fresh-cut plant and said balloon is inflated with a gas or gases conducive to the maintenance of said plant.

6. A package combination according to claim 4 wherein water and nutrients are placed in said container for maintenance of said article.

7. A package combination according to claim 5 wherein water and nutrients are placed in said container for maintenance of said article.

8. A package combination according to claim 6 wherein a securing member is mounted on said container to secure said article thereto.

* * * * *

UNITED STATES PATENT AND TRADEMARK OFFICE

CERTIFICATE OF CORRECTION

PATENT NO. : 4,811,841

DATED : March 14, 1989

INVENTOR(S) : Peter Domenichiello

It is certified that error appears in the above-identified patent and that said Letters Patent is hereby corrected as shown below:

In Claim 2, column 4, line 22 of the Patent, change "claim 6" to -- claim 1 -- .

In Claim 3, column 4, line 25 of the Patent, change "claim 6" to -- claim 1 -- .

In Claim 4, column 4, line 29 of the Patent, change "claim 6" to -- claim 1 -- .

Signed and Sealed this

Second Day of October, 1990

*Attest:*

HARRY F. MANBECK, JR.

*Attesting Officer*

*Commissioner of Patents and Trademarks*